US006607249B2

(12) United States Patent
Taitt

(10) Patent No.: US 6,607,249 B2
(45) Date of Patent: Aug. 19, 2003

(54) CONICAL BIT PENETRATOR POCKET PROTECTOR FOR EARTH DISPLACEMENT EQUIPMENT

(75) Inventor: Ronnie R. Taitt, Carterville, IL (US)

(73) Assignee: The Sollami Company, Herrin, IL (US)

( * ) Notice: Subject to any disclaimer, the term of this patent is extended or adjusted under 35 U.S.C. 154(b) by 0 days.

(21) Appl. No.: 09/727,981

(22) Filed: Nov. 30, 2000

(65) Prior Publication Data

US 2002/0063467 A1 May 30, 2002

Related U.S. Application Data

(60) Provisional application No. 60/168,508, filed on Dec. 2, 1999.

(51) Int. Cl.[7] ..... E21C 25/10
(52) U.S. Cl. ..... 299/111; 299/110
(58) Field of Search ..... 299/106, 107, 299/110, 111

(56) References Cited

U.S. PATENT DOCUMENTS

| | | | | |
|---|---|---|---|---|
| 3,830,546 A | | 8/1974 | Kniff | |
| 4,342,486 A | * | 8/1982 | O'Neill | 299/107 |
| 4,405,178 A | * | 9/1983 | Brandenburg | 299/81.2 |
| 4,488,759 A | * | 12/1984 | Bergqvist | 299/110 |
| 4,702,525 A | * | 10/1987 | Sollami et al. | 299/111 |
| 6,244,665 B1 | * | 6/2001 | Bise et al. | 299/106 |

FOREIGN PATENT DOCUMENTS

| | | | |
|---|---|---|---|
| DE | 2716177 A1 | * | 10/1977 |
| JP | 8-86185 | * | 4/1996 |

OTHER PUBLICATIONS

"efunda" web page, http://www.efunda.com/designstandards/plastic_design/radius.cfm, 2002.*

* cited by examiner

*Primary Examiner*—Heather Shackelford
*Assistant Examiner*—John Kreck
(74) *Attorney, Agent, or Firm*—Pitts & Brittian, P.C.

(57) ABSTRACT

A conical bit penetrator pocket protector for earth displacement equipment for maximizing penetration into hard rock during trenching, drilling, mining, or boring operations. The bit penetrator pocket protector for earth displacement equipment includes a body which defines an upper bit end and a lower shank end. The upper bit end defines a bit insert opening configured to detachably accept a penetrator bit tip. The lower shank end is configured to be securable to a penetrator holder that is welded to an implement of earth working equipment such as trenching equipment, rock saw equipment and/or a rotatable drum, or the like. A flange, or pocket protector, is defined between the upper and lower ends in order to provide protection for the bit penetrator lower end and a holder in which it is received by miniring rock and earth fines from contacting and building up between the holder and bit penetrator. Further, the flange acts as a load bearing surface between the bit penetrator and the holder, thereby protecting the lower end of the bit penetrator and the full face of the holder.

10 Claims, 2 Drawing Sheets

CONICAL BIT PENETRATOR POCKET PROTECTOR FOR EARTH DISPLACEMENT EQUIPMENT

CROSS-REFERENCE TO RELATED APPLICATIONS

This application claims the benefit of U.S. Provisional Application No. 60/168,508, filed Dec. 2, 1999.

STATEMENT REGARDING FEDERALLY SPONSORED RESEARCH OR DEVELOPMENT

Not Applicable.

BACKGROUND OF THE INVENTION

1. Field of Invention

This invention relates to the field of earth working equipment and specifically to a earth penetrator bit which is configured to penetrate hardened earth or rock.

2. Description of the Related Art

Penetrator bits are attached to a steel baseplate which is secured to a chain, and/or to mounting blocks mounted on a rotatable wheel or drum for excavation of rock and highly compressed earth. Conventional penetrator bits are manufactured from hardenable alloy steel and/or tungsten carbide, and are configured for use in penetrating and removing rock and material of the like from an excavation or mining site. The upper end of a conventional penetrator bit defines a conical configuration, a penetrator tip being carried by the distal end thereof. At the lower end of the bit is provided a means for removably attaching it to a holder carried on an implement of earth working equipment such as cutting chain equipment, a rotatable drum or the like. After repeated use, it is well-known that the penetrator tip wears away and the bit must be replaced due to wear by grinding of rock waste materials generated during boring, drilling, mining, or trenching. When penetrating into and removing particularly hard earth or rocks from a bore hole or ditch, the number of bit replacements can be excessive.

In the field of rotary trenching, mining, and earth moving construction equipment, replaceable penetrator bits with carbide tips are utilized. Typically, a penetrator bit holder is welded to a chain attachment or rotatable drum device utilized for trenching, drilling, mining, or boring in rock. The penetrator bit holder is configured to retain a penetrator bit therein. When the tip of the penetrator bit is worn down, the bit is removed from the bit holder and replaced with a new penetrator bit.

It is an object of this invention to provide a penetrator bit specifically designed to penetrate hard rock during trenching, drilling, mining, or boring operations.

It is another object of the present invention to extend the life of penetrator bits and associated bit holders which are mounted on a trenching, drilling, mining, or boring implement of earth working equipment.

It is another object of the present invention to provide a tip insert for a penetrator bit which is configured to maximize penetration into hard rock, drilling, mining, boring or trenching operations, while removing rock waste materials from the bore hole or trench.

BRIEF SUMMARY OF THE INVENTION

Other objects and advantages will be accomplished by the present invention which includes a trenching, drilling, mining, and/or boring conical bit penetrator attachable to a holder connected to earth penetrator equipment and method of operating the same. The trenching conical bit penetrator is configured to maximize penetration into hard rock during trenching, drilling, mining, or boring operations.

The bit penetrator of the present invention includes a body which defines an upper bit end and a lower shank end. The upper bit end defines a bit insert opening configured to detachably accept a penetrator bit tip. The lower shank end is configured to be securable to a penetrator holder that is welded to an implement of earth working equipment such as the chain excavator or a rotatable drum, or the like. A flange, or pocket protector, is defined between the upper and lower ends in order to provide protection for the bit penetrator lower end and a holder in which it is received by minimizing rock and earth fines from contacting and building up between the holder and bit penetrator. Further, the flange acts as a load bearing surface between the bit penetrator and the holder, thereby protecting the lower end of the bit penetrator and the full face of the holder.

BRIEF DESCRIPTION OF THE SEVERAL VIEWS OF THE DRAWINGS

The above mentioned features of the invention will become more clearly understood from the following detailed description of the invention read together with the drawings in which.

DETAILED DESCRIPTION OF THE INVENTION

Figure 1:
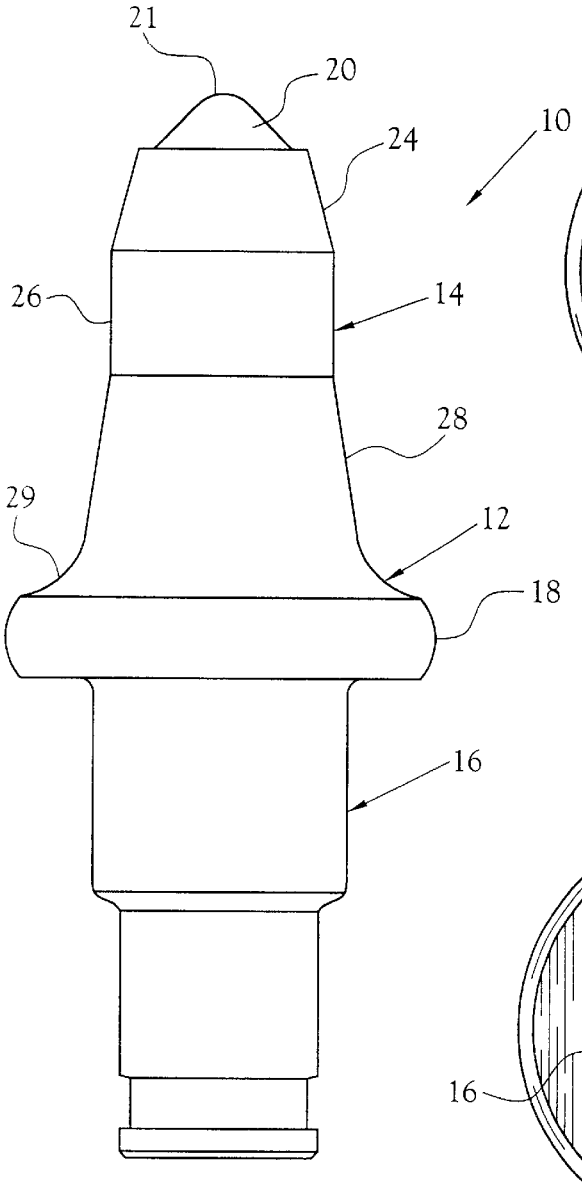
FIG. 1 is a side view of the conical bit penetrator pocket protector for earth displacement equipment constructed in accordance with several features of the present invention.
Figure 2:
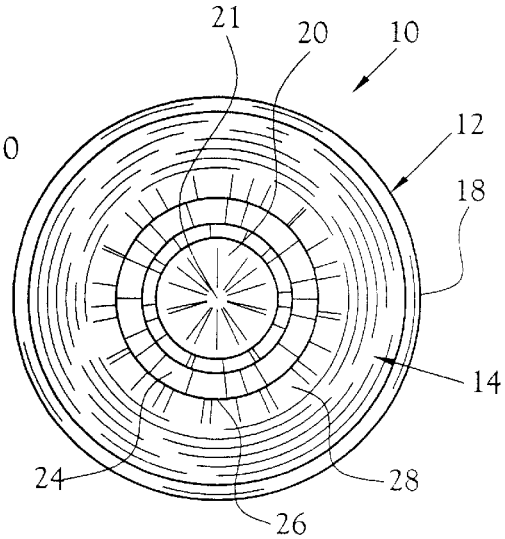
FIG. 2 is a top end view of the conical bit penetrator pocket protector for earth displacement equipment of the present invention.
Figure 3:
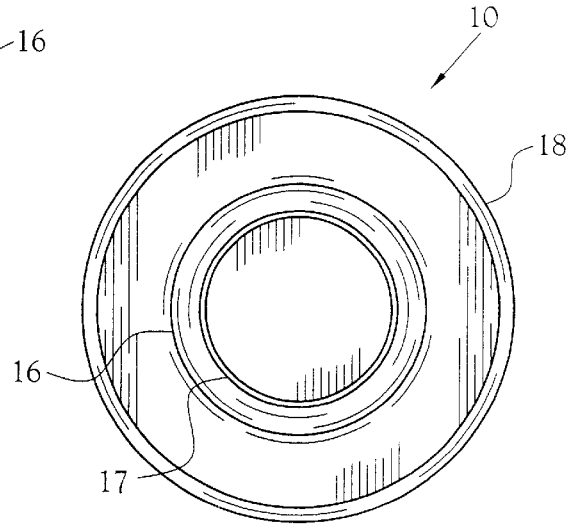
FIG. 3 is a bottom end view of the conical bit penetrator pocket protector for earth displacement equipment of the present invention.

A conical bit penetrator pocket protector for earth displacement equipment incorporating various features of the present invention is illustrated generally at 10 in the figures. The conical bit penetrator pocket protector for earth displacement equipment, or bit penetrator 10, is designed to penetrate rock and hardened earth more efficiently with a penetrator bit insert 20 while extending the life of the insert 20. The insert 20 is insertable into the bit penetrator 10, which is attachable to trenching equipment or earth working equipment such as a chain excavator or a rotatable drum or hammer equipment, or the like. In one embodiment, the bit penetrator 10 is designed to receive an insert 20 of a configuration to maximize penetration into hard rock formations.

The bit penetrator 10 of the present invention can be formed by casting, hot or cold forming, or machining from solid bar stock. In the preferred embodiment, the penetrator body 12 is fabricated from steel and the insert 20 is fabricated from tungsten carbide. However, it will be understood that other materials of manufacture may be used to accomplish similar results, depending upon the particular use thereof The bit penetrator 10 defines a body 12 including an upper end 14 and a lower end 16. A flange 18 is defined between the upper and lower ends 14,16. The flange 18 serves as a pocket protector as will be described below. The upper end 14 defines an insert receptor 22, for receiving an insert 20, as most clearly illustrated in FIG. 4. The insert receptor 22 is configured to receive and retain an insert 20 of a selected diameter.

The body 12 further defines at least one tapered portion between the flange 18 and the upper end 14. The tapers defined by the upper end 14 of the bit penetrator 10, shown as surfaces 24 and 28 in the figures, serve to reduce the diameter from the flange 18 to the upper end to effectively define a substantially conical configuration. In the illustrated embodiment, the surface 28 defines a slope of about ten degrees (10°) and the surface 24 defines a slope of about sixteen degrees (16°). It will be understood that more or fewer sloped surfaces may be provided to accomplish the objects of the present invention. A radiused surface 29 is provided as a transition from the flange 18 to the surface 28 in order to prevent the upper end 14 from breaking at the flange 18. The substantially conical configuration of the upper end 14 of the bit penetrator 10 provides enhanced removal of cutting materials and debris past the flange 18 and out of the cutting hole, trench, or tunneling bore. As a result of the enhanced removal, such configuration reduces friction against cutting materials and debris, and thereby reduces heat generated by the bit penetrator 10. It has been demonstrated that improved penetration and production from about 40% to about 100% over prior art devices is accomplished as a result of this configuration.

Figure 4:
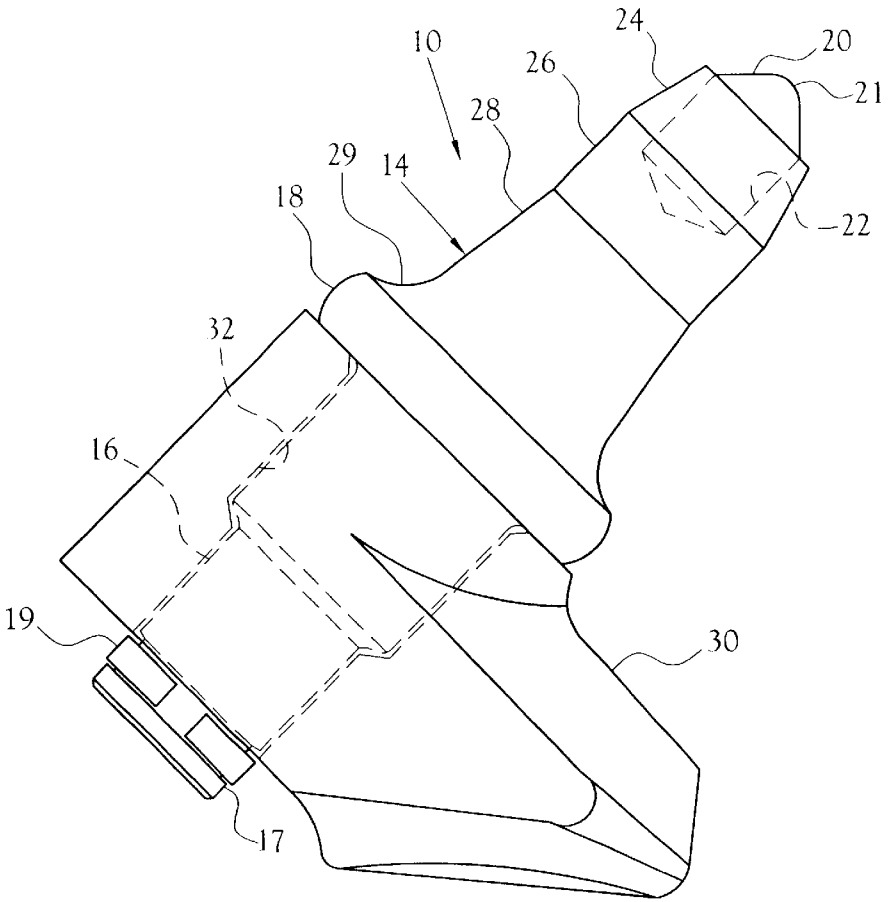
FIG. 4 is a side view of a typical holder for the conical bit penetrator pocket protector of the present invention, a conical bit penetrator pocket protector of the present invention being received therein.

The lower end 16 of the body 12 defines a shank configured to be received within a holder 30, as illustrated best in FIG. 4. In the illustrated embodiment, the lower end 18 of the body 12 defines a double-step shank having a reduced radius at the distal end thereof. While such embodiment is illustrated, it will be understood that other conventional shank constructions may be incorporated effectively. The holder 30 is securable by conventional means such as welding to an implement of earth working equipment. To this extent, the holder 30 defines a through opening 32 configured to loosely receive the lower end 16 of the body 12 in order to allow free rotation of the bit penetrator 10 therein. The lower end 16 of the illustrated embodiment defines a radial receptor 17 for receiving a retainer clip 19. The radial receptor 17 is disposed a distance from the flange 18 slightly greater than the length of the holder through opening 32 so as not to prevent free rotation of the bit penetrator 10. The retainer clip 19 is configured to be closely received within the radial receptor 17 when the bit penetrator lower end 16 is received within the holder through opening 32. The retainer clip 19 is further configured to define an outer diameter greater than the diameter of the holder through opening 32, thus serving to prevent extraction of the bit penetrator 10 from the holder 30. It will be understood that other means for removably securing the bit penetrator 10 within the holder 30 to allow free rotation of the bit penetrator 10 may be incorporated with similar results.

The flange 18 provides protection for the bit penetrator lower end 16 and the holder 30 in which it is received by minimizing rock and earth fines from contacting and building up between the holder 30 and bit penetrator 10. Further, the flange 18 acts as a load bearing surface between the bit penetrator 10 and the holder 30, thereby protecting the lower end 16 of the bit penetrator 10 and the face 34 of the holder 30.

The insert 20 is secured within the receptor 22 by conventional means such as brazing or welding. The insert 20 defines a conical configuration on its distal end, or tip 21. In the preferred embodiment, the insert 20 is fabricated from tungsten carbide or diamond material. It will be understood, although not illustrated, that the insert 20 may be releasably received within the receptor 22 for removal and replacement thereof From the foregoing description, it will be recognized by those skilled in the art that a bit penetrator for earth working equipment offering advantages over the prior art has been provided. Specifically, the bit penetrator is designed to maximize penetration into hard rock formations, and to extend the life of a penetrator bit insert. Further, the bit penetrator is configured to receive a penetrator bit insert formed from tungsten carbide or diamond materials. The bit penetrator flange provides protection for the lower shank end and the full face of the holder in which it is received by minimizing rock and earth fines from contacting and building up between the holder and bit penetrator. Further, the flange acts as a load bearing surface between the bit penetrator and the holder, thereby protecting the lower end of the bit penetrator and the full face of the holder.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A bit penetrator for mounting within a through opening defined within a holder mounted on earth displacement equipment, said bit penetrator comprising:

a body, said body defining:

an upper end defining a proximal end and a distal end, said distal end defining an insert receptor, said upper end defining a substantially conical configuration reducing in diameter from said proximal end to said distal end, said upper end defining a first sloped surface at said distal end, a second sloped surface, and a radiused surface between said second sloped surface and said proximal end, said upper end further defining a cylindrical surface extending between said first sloped surface and said second sloped surface;

a lower end defining a retainer receptor, said lower end being configured to be rotatably received through the holder through opening;

a flange dividing said upper end and said lower end, said upper end radiused surface providing a transition from said upper end second sloped surface to a perimeter of said flange to assist in deflecting material away from said bit penetrator, said flange defining a diameter larger than a diameter defined by said lower end to prevent excavated material from entering the holder through opening, whereby said flange is a load bearing surface between said bit penetrator and the holder, and whereby said flange protects the face of the holder and the interior surface of the holder through opening and said body lower end; and an insert configured to be received within said upper end insert receptor; and a retainer configured to be mounted in said retainer receptor defined by said body lower end, said retainer preventing removal of said bit penetrator from the holder.

2. The bit penetrator of claim 1 wherein said first sloped surface defines a slope of about ten degrees (10°).

3. The bit penetrator of claim 2 wherein said second sloped surface defines a slope of about sixteen degrees (16°).

4. A bit penetrator for mounting on earth displacement equipment, said bit penetrator comprising:

a holder defining a face and a through opening having an interior surface and opening on said face, said holder adapted to be mounted on earth displacement equipment;

a body, said body defining:

an upper end defining a proximal end and a distal end, said distal end defining an insert receptor, said upper end defining a substantially conical configuration reducing in diameter from said proximal end to said distal end, said upper end defining a first sloped surface at said distal end, a second sloped surface, and a radiused surface between said second sloped surface and said proximal end, said upper end further defining a cylindrical surface extending between said first sloped surface and said second sloped surface;

a lower end defining a retainer receptor, said lower end being configured to be rotatably received within said holder through opening;

a flange dividing said upper end and said lower end, said upper end radiused surface providing a transition from said upper end second sloped surface to a perimeter of said flange to assist in deflecting material away from said bit penetrator, said flange defining a diameter larger than a diameter defined by said lower end to prevent excavated material from entering said holder through opening, whereby said flange is a load bearing surface between said bit penetrator and said holder, and whereby said flange protects said face of said holder and said interior surface of said holder through opening and said body lower end; and an insert configured to be received within said upper end insert receptor; and a retainer configured to be mounted in said retainer receptor defined by said body lower end, said retainer preventing removal of said bit penetrator from said holder.

5. The bit penetrator of claim 4 wherein said first sloped surface defines a slope of about ten degrees (10°).

6. The bit penetrator of claim 5 wherein said second sloped surface defines a slope of about sixteen degrees (16°).

7. A method for manufacturing a bit penetrator for mounting within a through opening defined within a holder mounted on earth displacement equipment, said method comprising the steps of:

forming a body to define:

an upper end defining a proximal end and a distal end, said upper end defining a substantially conical configuration reducing in diameter from said proximal end to said distal end, said upper end defining a first sloped surface at said distal end, a second sloped surface, and a radiused surface between said second sloped surface and said proximal end, said upper end further defining a cylindrical surface extending between said first sloped surface and said second sloped surface;

a lower end configured to be rotatably received through the holder through opening; and a flange dividing said upper end and said lower end, said upper end radiused surface providing a transition from said upper end second sloped surface to a perimeter of said flange to assist in deflecting material away from said bit penetrator, said flange defining a diameter larger than a diameter defined by said lower end to prevent excavated material from entering the holder through opening, whereby said flange protects the full face of the holder and the interior surface of the holder through opening and said body lower end, said body defining an elongated, cylindrical configuration;

forming an insert receptor in said upper end distal end for receiving a cutting insert therein; and mounting an insert within said insert receptor.

8. The method of claim 7, after said step of forming a body, further comprising the step of forming a retainer receptor in said lower end.

9. The bit penetrator of claim 7 wherein said first sloped surface defines a slope of about ten degrees (10°).

10. The bit penetrator of claim 9 wherein said second sloped surface defines a slope of about sixteen degrees (16°).

* * * * *